US010904952B2

(12) United States Patent
Jeong et al.

(10) Patent No.: US 10,904,952 B2
(45) Date of Patent: Jan. 26, 2021

(54) SURFACE HEATER, THE ELECTRIC RANGE COMPRISING THE SAME, AND THE MANUFACTURING METHOD OF THE SAME

(71) Applicant: LG ELECTRONICS INC., Seoul (KR)

(72) Inventors: Changwoo Jeong, Seoul (KR); Youngjun Lee, Seoul (KR); Deok Hyun Hwang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 358 days.

(21) Appl. No.: 15/900,474

(22) Filed: Feb. 20, 2018

(65) Prior Publication Data

US 2018/0242402 A1 Aug. 23, 2018

(30) Foreign Application Priority Data

Feb. 21, 2017 (KR) ..... 10-2017-0023120

(51) Int. Cl.

| | |
|---|---|
| ***H05B 3/74*** | (2006.01) |
| ***H05B 3/14*** | (2006.01) |
| ***H05B 3/00*** | (2006.01) |
| ***H05B 3/18*** | (2006.01) |
| ***H05B 3/28*** | (2006.01) |
| ***H05B 3/68*** | (2006.01) |
| ***H05B 3/26*** | (2006.01) |

(52) U.S. Cl.

CPC ..... *H05B 3/746* (2013.01); *H05B 3/0071* (2013.01); *H05B 3/141* (2013.01); *H05B 3/18* (2013.01); *H05B 3/265* (2013.01); *H05B 3/28* (2013.01); *H05B 3/688* (2013.01); *H05B 2203/01* (2013.01); *H05B 2203/013* (2013.01)

(58) Field of Classification Search

CPC ..... H05B 2203/013; H05B 2203/01; H05B 3/688; H05B 3/28; H05B 3/265; H05B 3/18; H05B 3/141; H05B 3/0071; H05B 3/746

USPC ..... 219/443.1

See application file for complete search history.

(56) References Cited

U.S. PATENT DOCUMENTS 2,456,201 A * 12/1948 Lee ..... H05B 3/688 219/467.1
2,456,202 A * 12/1948 Lee ..... H05B 3/688 219/530

(Continued)

FOREIGN PATENT DOCUMENTS

DE 3116589 A1 3/1982
EP 0 319 079 A1 6/1989

(Continued)

OTHER PUBLICATIONS

Office Action of Korean Patent Office in Appl'n No. 10-2017-0023120, dated Jul. 29, 2019.

(Continued)

*Primary Examiner* — Benjamin R Shaw
(74) *Attorney, Agent, or Firm* — Dentons US LLP

(57) ABSTRACT

A surface heater including a substrate, an insulating layer positioned on the substrate, and a heater layer positioned on the insulating layer, wherein the insulating layer and the heating layer are co-fired.

18 Claims, 5 Drawing Sheets

(56) References Cited

U.S. PATENT DOCUMENTS 2,787,694 A * 4/1957 Farries ..... H05B 3/86 219/202
3,805,023 A * 4/1974 Wainer ..... H05B 3/748 219/543
3,869,596 A * 3/1975 Howie ..... H05B 3/26 219/438
3,978,315 A * 8/1976 Martin ..... H05B 3/265 219/543
4,511,789 A * 4/1985 Goessler ..... F24C 15/106 219/448.11
4,810,857 A * 3/1989 Goessler ..... H05B 3/746 219/448.19
5,448,037 A * 9/1995 Takase ..... B32B 17/10174 219/547
6,121,589 A * 9/2000 Tanaka ..... H05B 3/26 219/543
6,222,166 B1 * 4/2001 Lin ..... H05B 3/262 219/538
6,450,025 B1 * 9/2002 Wado ..... B81B 3/0072 73/204.26
2004/0104212 A1 * 6/2004 Gadow ..... H05B 3/00 219/465.1
2005/0109768 A1 * 5/2005 Aoki ..... H05B 3/265 219/543
2006/0102613 A1 5/2006 Kuibira et al.
2006/0267614 A1 * 11/2006 Lee ..... H05B 3/265 324/750.11
2013/0175257 A1 * 7/2013 Lee ..... H05B 3/265 219/552
2014/0239484 A1 * 8/2014 Matsuda ..... H01L 21/4871 257/712
2016/0007474 A1 * 1/2016 Dardona ..... H05B 3/06 219/543
2016/0316519 A1 * 10/2016 Gomez ..... H05B 3/141
2017/0208649 A1 * 7/2017 Tabushi ..... H05B 3/06
2017/0245323 A1 * 8/2017 Lee ..... H05B 3/74
2018/0332669 A1 * 11/2018 Kuchimachi ..... H01L 21/02
2020/0063975 A1 * 2/2020 Song ..... F24C 7/083
2020/0063977 A1 * 2/2020 Song ..... H05B 3/03

FOREIGN PATENT DOCUMENTS

EP 1 531 651 A2 5/2005
JP 08243991 A 9/1996
JP 2011023178 A 2/2011
KR 10-2010-0103448 A 9/2010
KR 10-2012-0028026 A 3/2012
KR 10-1637122 B1 7/2016
WO 2009/129615 A1 10/2009
WO 2013/073276 A1 5/2013

OTHER PUBLICATIONS

Office Action of Korean Patent Office in Appl'n No. 10-2017-0023120, dated Nov. 27, 2019.
Office Action of European Patent Office in Appl'n No. 18157321.3, dated Feb. 13, 2020.

* cited by examiner

100

SURFACE HEATER, THE ELECTRIC RANGE COMPRISING THE SAME, AND THE MANUFACTURING METHOD OF THE SAME

CROSS-REFERENCE TO RELATED APPLICATION

This application claims priority to and the benefit of Korean Patent Application No. 10-2017-0023120, filed on Feb. 21, 2017, the disclosure of which is incorporated herein by reference in its entirety.

BACKGROUND

1. Field of the Invention

The present invention relates to a surface heater of heating by using electricity used in a heating device field such as an electric range.

2. Description of Related Art

A cooktop used as a home or commercial cooking appliance is a cooking appliance that heats food contained in a container by heating a container placed on an upper surface thereof. The most generally used cooktop method to date is a gas range type that generates a flame directly by using a gas.

However, the gas range necessarily generates a toxic and combustible gas during a combustion process of the gas. This gas causes an environmental pollution of the indoor air and the health of the cooker, as well as a fatal difficulty of expanding an additional ventilation facility economically.

Due to the above, in order to replace the gas range, there is a steadily increasing demand for the electric range in which electricity is used to heat the container and/or the food on the substrate. In spite of relatively high price compared to gas range, the electric range is safer and more energy efficient, so it is expanding its range from conventional industrial fields to home use.

In order to replace the gas range, there is a steadily increasing demand for an electric range in which electricity is used to heat the container and/or the food on the substrate. In spite of relatively high price compared to the gas range, the electric range is safer and more energy efficient, so it is expanding its range from conventional industrial field to a home use.

The heater layer for heating in the conventional electric range is formed by coating a paste containing a metal material and glass frit directly on the rear surface of a substrate of glass or ceramic, etc. in a predetermined pattern shape, and sintering to implement a heating element. In addition, a plate type heater formed on a substrate, which generates a heat by supplying the electricity to the heating element, is widely used.

At this time, when the plate type heater is heated to a desired high temperature, the glass, etc., which is a substrate, sharply decreases in specific resistance at a high temperature due to an inherent characteristic of the material. This is because an electrical conduction in the insulator to which the glass, etc. belongs is mainly generated by a lattice vibration or phonon. When the temperature rises, a lattice vibration becomes active due to an increase in thermal activation of an insulator lattice, thereby increasing the electrical conductivity of the insulator (decreasing the resistivity).

However, when the resistance of the substrate is reduced, a leakage current is generated on the upper surface of the substrate, thereby causing a fatal problem that threatens the safety of the user. Also, the possibility of generating a short circuit in a heating element formed on a substrate due to the substrate with a reduced resistance at a high temperature is greatly increased.

A related art is Korean Patent Laid-Open Publication No. 10-2014-0120400, which discloses a surface heater using a ceramic thin film heating element and a manufacturing method thereof.

SUMMARY OF THE INVENTION

The present invention provides a surface heater and an electric range to which a new component is added in order not to be exposed to an electric shock due to a leakage current on the upper surface of the substrate when using the heater, in the heater used in the cooktop such as the electric range.

In addition, the present invention provides the surface heater and the electric range of which has a new configuration for preventing a short circuit current generation (in other words, a break-down of the heater module) in a heater layer heating element due to a decrease in resistance of the substrate during high output driving of the heater.

In addition, the present invention is a method of manufacturing the above-mentioned surface heater and the electric range, and provides the method of manufacturing the surface heater and the electric range of obtaining the process simplification and the adhesive force securing effect by using the Low Temperature Ceramics Co-firing (hereinafter referred to as LTCC) process and material.

In order to solve the above-described technical problems, in accordance with an aspect of the present invention, a surface heater including the insulating layer positioned on the substrate; a heater layer positioned on the insulating layer may be provided. Preferably, it is the surface heater characterized in that the substrate is any one of the glass, Glass ceramics, or a ceramics.

Preferably, it is the surface heater characterized in that the insulating layer includes any one of Boron nitride, Aluminium nitride, or Silicon nitride.

Preferably, it is the surface heater characterized in that the insulating layer includes Glass frit as the binder.

Particularly, it is the surface heater characterized in that the binder includes a Borosilicate component and/or a Bentonite component.

Preferably, it is the surface heater characterized in that the heater layer includes any one or more lanthanide oxide of the group consisting of Lanthanum Strontium Manganite (LSM), Lanthanum Strontium Cobalt Ferrite (LSCF), Lanthanum Nickel Ferrite (LNF) and Lanthanum Cobalt oxide (LC).

Preferably, it is the surface heater characterized in that the heater layer includes the metal powder.

Particularly, it is the surface heater characterized in that the metal powder includes any one or more selected from the group consisting of Ag, Ag—Pd, and Cu.

Meanwhile, it is the surface heater characterized in that the heater layer includes the glass frit having the same component as the binder of the insulating layer.

In accordance with another aspect of the present invention, an electric range including any one of the above-mentioned surface heater may be provided.

In accordance with still another aspect of the present invention, a method of manufacturing a surface heater, characterized in including: preparing a substrate; coating an insulating layer on the substrate; coating a heater layer on the insulating layer; and co-firing the insulating layer and the heater layer.

Preferably, it is the method of manufacturing the surface heater characterized in including coating the insulating layer and/or coating the heater layer, and subsequently, drying the heater layer.

Preferably, it is the method of manufacturing the surface heater characterized in that the substrate includes any one of the glass, Glass ceramics, or the ceramics.

Preferably, it is the method of manufacturing the surface heater characterized in that the insulating layer includes any one of Boron nitride, Aluminium nitride, or Silicon nitride.

Preferably, it is the method of manufacturing the surface heater characterized in that the insulating layer includes the Glass frit as the binder.

Particularly, it is the method of manufacturing the surface heater characterized in that the binder includes Borosilicate component and/or Bentonite component.

Preferably, it is the method of manufacturing the surface heater characterized in that the heater layer includes any one or more lanthanide oxide of the ground consisting of LSM, LSCF, LNF, and LC.

Preferably, it is the method of manufacturing the surface heater characterized in that the heater layer includes the metal powder.

Preferably, it is the method of manufacturing the surface heater characterized in that the metal powder includes any one or more selected from the group consisting of Ag, Ag—Pd, and Cu.

Meanwhile, it is the method of manufacturing the surface heater characterized in that the heater layer includes the Glass frit having the same component as the binder of the insulating layer.

In accordance with the present invention, by inserting an insulating layer having high specific resistance, heat resistance, low coefficient of thermal expansion and high thermal conductivity at a high temperature, between a conventional heater layer and a substrate, it is possible to secure high resistance of the surface heater at high temperature. As a result, the surface heater and the electric range including the same of the present invention suppress the short circuit current between the heating elements constituting the heater layer and the heater module break-down can be prevented, thereby securing a stability and a durability of the surface heater and the electric range.

In addition, since the surface heater and the electric range of the present invention can suppress the leakage current to the rear surface of the substrate due to the insertion of the insulating layer, it is possible to prevent the electric shock accident of the user and to improve the safety of the surface heater and the electric range.

In addition, the method of manufacturing the surface heater and the electric range of the present invention reduces the Lead time and Tack time in the manufacturing through the process simplification using LTCC process, even though the process number is increased for the formation of the insulation layer, thereby having an effect of improving the productivity in manufacturing the surface heater and the electric range.

In addition, in the method of manufacturing the surface heater and the electric range of the present invention, it may have the effect of sufficiently securing the adhesive strength of the insulating layer and the substrate by using the heater layer and the insulating layer material for LTCC process, substantially increasing the available temperature of the heating element which is the component of the heater layer, and inhibiting a reaction of the insulating layer with the heating layer during firing.

Additionally, the surface heater and the electric range in accordance with the present invention can control the resistance of the insulating layer by changing the component of the inorganic binder constituting the insulating layer.

In addition, the surface heater and the electric range in accordance with the present invention can obtain the effect of stably securing the resistance of the heating element by including the metal in the heating element constituting the heater layer.

DETAILED DESCRIPTION OF EXEMPLARY EMBODIMENTS

Hereinafter, a surface heater, an electric range and a method of manufacturing the same in accordance with the preferred embodiments of the present invention will be described in detail with reference to the drawings attached hereto.

The present invention is not limited to the embodiments disclosed below and may be embodied in various forms different from each other, and the present embodiments are merely provided to be complement in the disclosure of the present invention and perfectly inform the range of the invention for the skilled person in the art.

Figure 1:
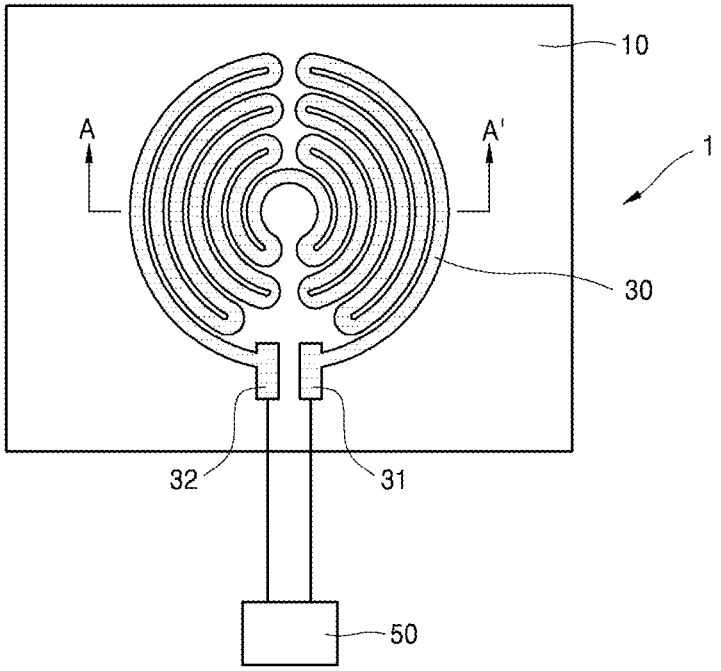
FIG. 1 is a top view of a surface heater in accordance with an exemplary embodiment of the present invention as viewed from a substrate.
Figure 2:
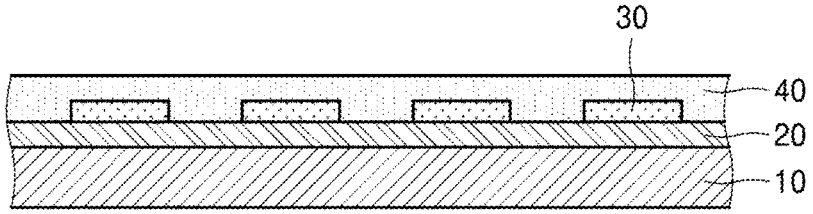
FIG. 2 is an enlarged sectional view showing an example of a part cut along line A-A' of the surface heater of FIG. 1.
Figure 3:
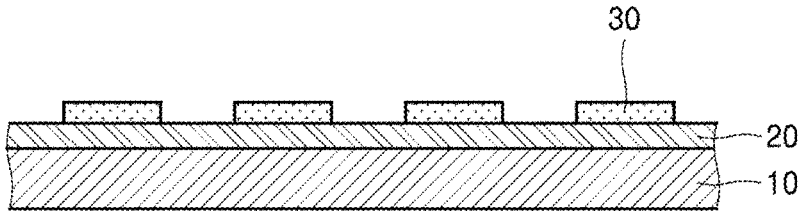
FIG. 3 is an enlarged cross-sectional view showing another example of a part cut along line A-A' of the surface heater of FIG. 1.

Referring to FIGS. 1 to 3, a surface heater 1 in accordance with an exemplary embodiment of the present invention includes a substrate 10 including a surface made of an electrically insulating material, an insulating layer 20 formed on the substrate, a heater layer 30 made of a heating element attached on an insulating layer 20 formed on the substrate 10 by sintering a predetermined powder included with an oxide powder, and a power supply part 50 of supplying the electricity to the heater layer 30.

The substrate 10 in the present invention may be a plate type member. The substrate 10 can be manufactured in various sizes and shapes according to the needs of the equipment using the surface heater 1. In addition, the substrate 10 may have different thickness depending on the position in the substrate, as necessary. Furthermore, it is possible that the substrate 10 can be bent as necessary.

The material forming the substrate 10 may be an insulating material, and is not particularly limited. However, it is preferable to include any one of the glass, the glass ceramics, and the ceramics. These materials can secure basically the insulating property, as well as more favorable to resistant to contamination, fingerprints, and visual aspects than other materials. Particularly, Glass ceramics are most preferable since the glass ceramics can secure the impact resistance and the low expansion property in addition to the benefit of the general amorphous glass of the transparency and beauty.

The insulating layer 20 is provided on the substrate 10 on one side of the substrate 10 where the heater layer 30 is formed of both sides surfaces of the substrate 10. The insulating layer 20 has to be formed on all of the substrate 10 or a part of the substrate. Here, the part of the substrate means a part of the substrate which the user can at least contact in the operation of the surface heater or the electric range and/or the contact part of the heater layer and the substrate.

It is preferable that the thickness after firing of the insulating layer after firing formed on the substrate is 1 to 1,000 μm. When the thickness of the insulating layer is thinner than 1 μm, it becomes difficult to secure the electrical stability of the insulating layer. On the other hand, when the thickness of the insulating layer is 1,000 μm or more, there is a high probability of occurrence of cracks, etc., due to the difference in material or thermal expansion coefficient between the insulating layer, the substrate and the heater layer, and the problem of the cost in the material and the process is generated.

It is preferable that the insulating layer includes any one of Boron nitride, Aluminum nitride, and Silicon nitride, which can stably secure the specific resistance even at a high temperature as a main temperature. All of the above components have a common point of an insulator based on a ceramic material.

Figure 4:
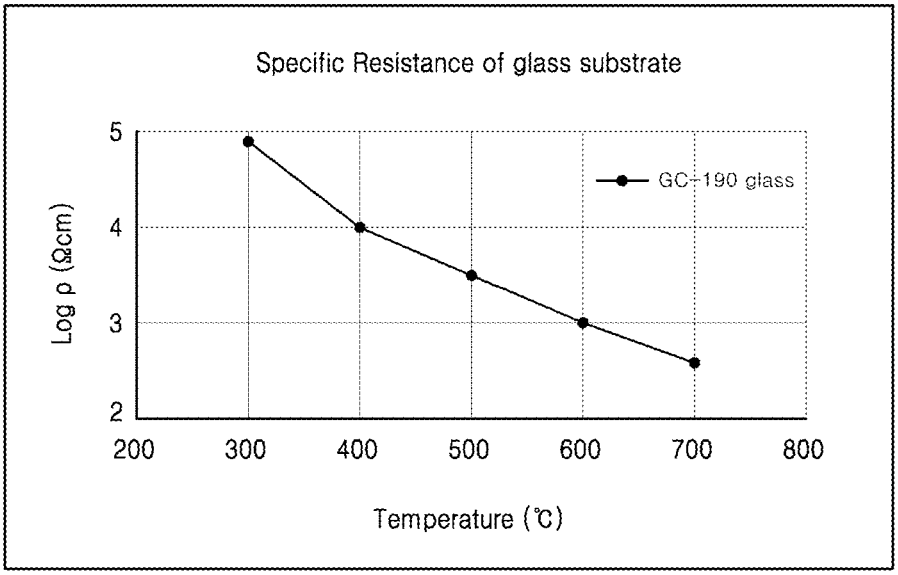
FIG. 4 shows a change in specific resistance according to the temperature of the glass ceramics.

FIG. 4 shows a change in specific resistance according to the temperature of a GC-190 glass substrate, which is one type of glass ceramics which can be used as a substrate in the present invention. As the temperature increases, the specific resistance of the glass substrate exponentially decreases (see FIG. 4 which the y-axis representing the specific resistance is log scale), it was confirmed that the specific resistance at 700° C., which is the typical heating maximum temperature of the electric range, is about $3.16*10^2$ Ωcm.

Figure 5:
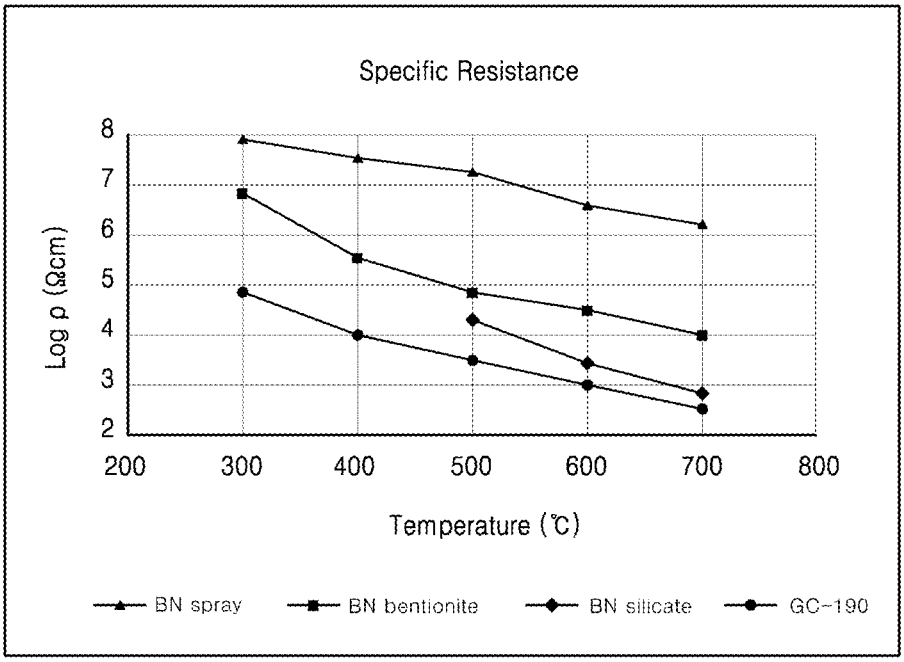
FIG. 5 shows a change in specific resistance according to the temperature of the insulating layer of the present invention.

In contrast, Boron nitride, which can be used as an insulating layer in the present invention, exhibits a specific resistance higher than that of a glass ceramics at a higher temperature and having less change. As shown in FIG. 5, as the temperature increases from 300° C. to 700° C., it was examined that the insulation layer manufactured using a paste constituting the inorganic with only boron nitride had a smaller decrease in specific resistance than crystalline glass as a substrate. Also, the specific resistance value at 700° C., which is a high temperature, was measured to be about $1.86*10^{-6}$ Ωcm, which is the value increased about 5,000 times greater than the specific resistance of the glass ceramics.

However, when the paste is formed of boron nitride only to form the insulating layer, the adhesion force to the substrate is lowered at a general firing temperature of about 1,000° C. or less. On the other hand, when the firing temperature is increased to improve the adhesion between the insulating layer and the substrate, the firing temperature which can secure the adhesive force due to a high melting point (about 2973° C.) of boron nitride is excessively high, and thus, there is a problem that the low temperature firing is impossible.

The present invention invented the insulation layer which secures the adhesive force with the substrate and/or the heater layer, and simultaneously have the high temperature specific resistance higher than that of the substrate, and is compatible with the process temperature of the printing layer which is relatively low temperature, and further, LTCC is possible with the printing layer.

For this, the paste capable of forming the insulating layer of the present invention has to further include an inorganic binder. In the present invention, a paste including a Glass frit as an inorganic binder has been invented, particularly in order to reduce the firing temperature. More specifically, the present invention invented a paste including a Borosilicate component and/or a Bentonite component as a Glass frit.

The paste referred in the present invention, means a state, in which a vehicle including a selection component such as various organic additive, and an essential component such as a solvent and an organic binder, and powder such as an inorganic substance taking charging of the main function on the substrate after the firing, are mixed.

However, since borosilicate and/or bentonite component are the main components to be general glass and/or ceramics material, when the components are added to the paste for the insulating layer, it causes a trade off relationship having the benefit of increasing the adhesive force of the insulating layer, with the substrate and/or the heating layer, together with the difficulty of reducing the specific resistance of boron nitride. In order to supplement the above difficulty, the present invention firstly manufactures the pastes which can primarily secure an adhesive strength of 30N or more, which can guarantee a stable adhesive force with the glass ceramics as a substrate, and then the pastes having high specific resistance are selected among the pastes.

It is preferable that the weight ratio of boron nitride to the Glass frit constituting the inorganic powders of the paste is (10 to 90) wt % to (90 to 10) wt %. When the ratio of boron nitride is less than 10%, the specific resistance of the insulator is determined by the specific resistance of the Glass frit, and there is a problem of making it impossible to secure high specific resistance property at high temperature. On the other hand, when the ratio of boron nitride exceeds 90%, the sintered density of the insulating layer is lowered and the excessive bubbles are present in the insulating layer, and the sintering temperature is increased, and thus, there is a problem of making LTCC with the printed layer difficult.

As shown in FIG. 5, the specific resistance value of a paste including Borosilicate as a Glass frit was examined to be closer to that of the glass ceramics as a substrate than that of boron nitride, as the temperature increases. However, the specific resistance value of the borosilicate paste was measured to be about $6.92*10^2$ Ωcm at 700° C. and it was examined that this value is 2 times or more than the resistivity value of the glass ceramics as the substrate.

Meanwhile, the specific resistance value of the paste including Bentonite component as the inorganic binder was examined to have a value corresponding to the intermediate degree of the specific resistance values of boron nitride, and the glass ceramics as the substrate (FIG. 5). Particularly, the specific resistance value of the bentonite-containing paste was measured to be about $8.24*10^3$ Ωcm at 700° C., and it was examined to be about 25 times or more than the specific resistance value of the glass ceramics as the substrate.

Figure 6:
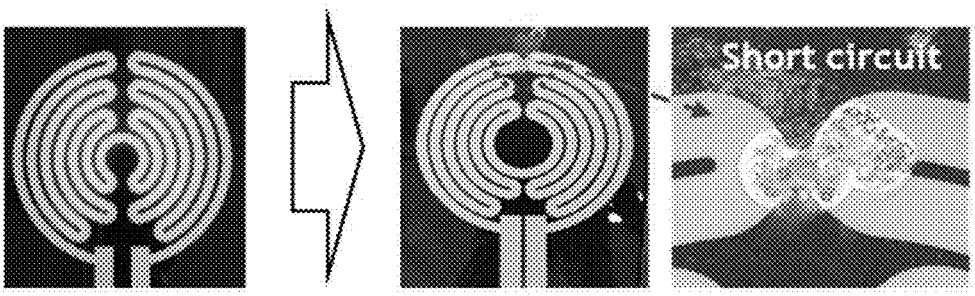
FIG. 6 shows an example in which a heater module is broken since a short circuit in a heating element of a heater layer is generated due to a decrease in specific resistance of the substrate during high output driving.

When the insulating layer 20 in accordance with the present invention is formed between the substrate 10 and the heater layer 30, it is possible to prevent the user from the electric shock accident due to a leakage current of the rear surface that may be caused by a decrease in the specific resistance of the substrate at a high temperature. In addition, the insulating layer 20 of the present invention prevents a short circuit current in the heating element of the heater layer 30 during high output driving of the heater layer 30 due to a relatively high resistivity at a high temperature (FIG. 6), thereby preventing the break-down of the heater layer 30.

In the present invention, the heater layer 30 made of the heating element attached on the insulating layer 20 formed on the substrate 10 is formed. At this time, the heating element of the heater layer 30 is arranged in a predetermined shape on the plane of the insulating layer 20. As an example referring to FIG. 1, the heating element may be formed by extending in a zigzag while changing a direction based on a semicircle along the circumference on the surface. The heating element may have a shape which is connected in series from the first terminal part 31 to the second terminal part 32 in a predetermined shape.

The heating element is formed by sintering a predetermined powder including a lanthanide oxide powder. 'The sintered temperature' of the predetermined powder is hereinafter referred to as 'a sintering temperature'. 'Lanthanide' means a substance which is an element La. 'Lanthanide oxide' means an oxidized compound including at least lanthanum (La). The lanthanide oxide has the electric conductivity and can be utilized as the heating element using the electricity.

The lanthanide oxide may be any one selected from the group consisting of LSM (Lanthanum Strontium Manganite), LSCF (Lanthanum Strontium Cobalt Ferrite), LNF (Lanthanum Nickel Ferrite) and LC (Lanthanum Cobalt Oxide).

The lanthanide oxide has an excellent oxidation resistance and has an effect that the heating element is not denatured even when the surface of the heating element of the heater layer 30 is exposed to the outside air without the coating layer 40 in FIG. 3.

In addition, the lanthanide oxide has a thermal expansion coefficient of about $10.8*10^{-6}$ to $12.3*10^{-6}$/K, which is lower than that of the metal, and it has the effect of preventing the delamination status of the heater layer 30, which may occur depending on the difference in the degree of volume expansion between the substrate 10 and the insulating layer 20 according to the temperature change.

The predetermined powder may include the powder of other materials other than the lanthanide oxide powder. The predetermined powder may include a metal powder. The predetermined powder may be a mixture included with the lanthanide oxide powder and the metal powder.

The metal has a higher electrical conductivity than the lanthanide oxide. The specific resistance of the heater layer 30 decreases as the predetermined powder includes the metal powder more.

In one experimental example, in the case of the heating element obtained by sintering the predetermined powder composed of only the lanthanide oxide powder, even when the lanthanide oxide powder was sintered at the same firing temperature, it shows a large deviation in the specific resistance measured by the result each implementation. In above one experiment, the value of the specific resistance of the heating element 30 was observed to vary from about $10^{-4}$ to about 1 Ωcm, for every implementation in which the same plurality of samples were sintered at the same firing temperature, it was observed that the value of the specific resistance locally is uneven for every part of the heating element constituting the heating element 30.

By including the metal powder in the predetermined powder, the specific resistance of the heater layer 30 can be repeatedly reproduced in a desired range while exhibiting the effect of the lanthanide oxide, and thus, there is an effect that it is easy to design the heating element in a desired range of the specific resistance by the designer.

The metal as the material of the metal powder may be any one of known materials. Preferably, the metal may be any one selected from the group consisting of Ag, Ag—Pd, and Cu.

The firing temperature of the lanthanide oxide is similar to that of Ag, Ag—Pd, and Cu relative to firing temperatures of other metals. When the metal is selected from the group consisting of Ag, Ag—Pd, and Cu, all particles of the predetermined powder can be effectively sintered each other during the firing of the predetermined powder.

Since the firing temperature of Ag, Ag—Pd, and Cu is lower than that of the lanthanide oxide, the firing temperature of the predetermined powder mixed with any one of Ag, Ag—Pd, and Cu has the effect of more lowering, compared to the firing temperature of the predetermined powder constituting the lanthanide oxide only.

The weight composition ratio of the lanthanide oxide powder and the metal powder of the predetermined powder may be variously implemented. For example, the predetermined powder may be composed of 25% by weight of the lanthanide oxide powder and 75% by weight of the metal powder. The predetermined powder may be composed of 75% by weight of the lanthanide oxide powder and 25% by weight of the metal powder. That is, the predetermined powder may include 25 to 75% by weight of the lanthanide oxide powder and 25 to 75% by weight of the metal powder. Further, the predetermined powder may be composed of 73% by weight of the lanthanide oxide powder, 25% by weight of the metal powder, and 2% by weight of the optional component powder to be described later.

It is preferable that the predetermined powder includes 30 to 60% by weight of the lanthanide oxide powder and 40 to 70% by weight of the metal powder. For example, the predetermined powder may be composed of 35% by weight of the lanthanide oxide powder and 65% by weight of the metal powder. In addition, the predetermined powder may be composed of 58% by weight of the lanthanide oxide powder, 40% by weight of the metal powder, and 2% by weight of the optional component powder to be described later.

Since the specific resistance of the metal is very low, when the weight ratio of the metal powder is higher than a predetermined standard, the heating function as the heater layer 30 is limited. It is preferable that the specific resistance for functioning as the heater layer 30 in the surface heater 1 is $10^{-5}$ Ωm or more. In order to obtain such a specific resistance, it is preferable that the weight ratio of the metal powder is limited to a specific numerical value or less, and it is preferable that the weight ratio of the metal powder is preferably 70 wt % or less.

In addition, when the weight ratio of the metal powder is higher than the predetermined standard, the specific resistance of the heater layer 30 may be significantly increased as the temperature of the heater layer 30 increases, and thus, it is preferable that the weight ratio of the metal powder is appropriately limited. This is because the specific resistance of the metal increases as the temperature increases as opposed to the insulator.

In addition, when the weight ratio of the lanthanide oxide powder is higher than the predetermined standard, it is difficult to obtain a predetermined specific resistivity whenever the heater layer 30 is manufactured. The description thereof has been described above. In the present invention, it has been derived that it is difficult to observe the predetermined specific resistance when sintering the predetermined powder including 70% by weight or 90% by weight of LC powder. Accordingly, it is preferable that the ratio of the weight of the lanthanide oxide is 60% by weight or less.

In addition, the heater layer 30 having a specific resistance in the range of $10^{-1}$ Ωm or less can be implemented. In the case of the surface heater, in order to heat the surface, the length of the heating element of the heater layer 30 beyond some extent has to be secured, and as the length increases, the resistance value increases. Thus, it is possible to design the surface heater 1 effectively by limiting to the heating element having the specific resistance having the appropriate value or less.

The optional component may include the same material as the material of the surface of the insulating layer 20. As a result, the attaching force between the insulating layer 20 and the heater layer 30 can be enhanced.

For example, the components of the component of the Glass frit and the optional components of the insulating layer 20 may include the same material. The predetermined powder may be a mixture including the lanthanide oxide powder, the metal powder, and the Glass frit powder. The % by weight of the Glass frit powder in the predetermined powder is 2% or less. The % by weight of the Glass frit powder in the predetermined powder may be about 1%.

It is preferable that the lanthanide oxide is LC. The firing temperature of the LSM, LSCF or LNF powder is about 1000 to 1200° C., while the firing temperature of the LC powder is relatively low, about 850° C. The substrate 110 made of Glass material as a base is vulnerable to a high temperature above a certain temperature. For example, a commonly used glass substrate 110 may be denatured when increasing to a temperature exceeding 950° C., and it is preferable not to exceed 850° C. Since the firing process proceeds in a state where the predetermined powder is disposed on the surface of the substrate 110, it is advantageous to use a LC powder having a low firing temperature.

It is preferable that the particle size ($D_{50}$) of the lanthanide oxide powder is about 0.4 μm. As the particle size of the powder is smaller, the firing temperature is lower, so that it is advantageous to attach the heater layer 30 by sintering the heating element to the insulating layer 20. However, when the particle size of the powder is too small, it may occur a problem that a dispersion is not uniform due to an agglomeration of the powder in a paste to be described later.

It is preferable that the metal is Ag. The firing temperature of the predetermined powder mixed with Ag—Pd or Cu powder is about 900 to 1000° C., while the firing temperature of the predetermined powder mixed with Ag powder is about 850 to 920° C. which is relatively low. It is advantageous to lower the firing temperature of the predetermined powder by using the predetermined powder mixed with Ag powder having a low firing temperature.

The coating layer 40 for protecting the heater layer may be selectively formed on the heater layer 30 in accordance with the present invention. The coating layer 40 is also made of an electrically insulating material. It is preferable that the coating layer 40 may be made of the same material as the surface of the substrate 10 or the insulating layer 20, and, as opposed to that, may be made of a different material from the surface of the substrate 10 or the insulating layer 20.

Figure 7:
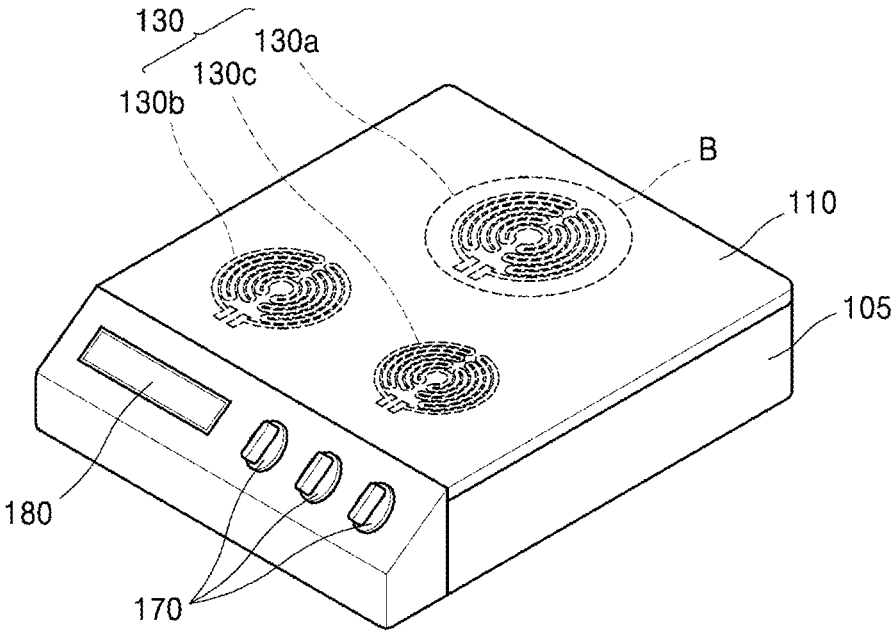
FIG. 7 is an external perspective view of an electric range in accordance with an exemplary embodiment of the present invention.
Figure 8:
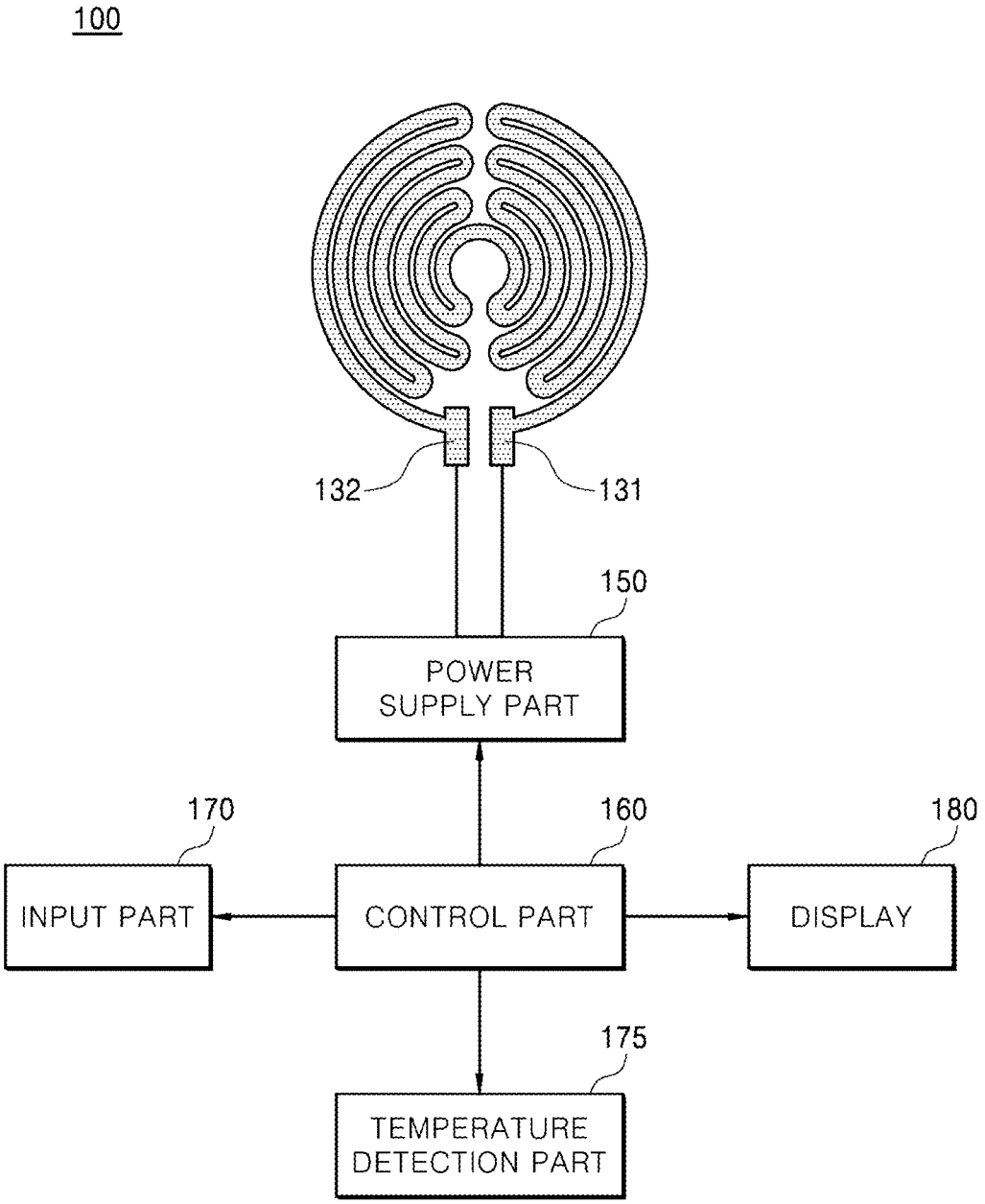
FIG. 8 is an example of an internal block diagram of the electric range of FIG. 7.

FIGS. 7 and 8 show an example of an electric range equipped with the surface heater of the present invention.

The electric range 100 may include a cabinet 105 having an open upper surface. The cabinet 105 forms the appearance of the electric range 100. Components of the electric range 100 are arranged inside the cabinet 105.

The electric range 100 includes the surface heater 1. In order to implement a conventional heating element having Ag—Pd as a main component, there is a problem that the manufacturing cost is high due to the scarcity of the Pd material. However, there is a benefit of solving the above problem by implementing the heating element 130 having lanthanide oxide as a main component.

The electric range 100 includes a substrate 110 including a surface made of an electrically insulating material. The substrate 110 may be arranged on the open upper surface of the cabinet 105. Hereinafter, an upper surface of the substrate 110 is understood as the upper surface, and a lower side surface of the substrate 110 is understood as a rear surface. The rear surface of the substrate 110 may be made of glass material or ceramics (e.g., alumina). A description overlapping with the description of the substrate 10 will be omitted.

The electric range 100 includes a heater layer 130 which the predetermined powder is sintered to attach to the rear surface of the substrate 110. The heater layer 130 includes a first terminal part 131 positioned at an initial end part and a second terminal part 132 positioned at a terminal end part based on a flow direction of supplied electricity. The description overlapped with the heater layer 30 will be omitted.

A plurality of heater layers 130 may be arranged. In this embodiment, the heater layer 130 includes a first heater layer 130*a*, a second heater layer 130*b* and a third heater layer 130*c* in the order of larger area attached to the substrate. The first heater layer 130*a*, the second heater layer 130*b*, and the third heater layer 130*c* may be arranged on the substrate 110, respectively, in different sizes or shapes.

The electric range 100 includes a power supply part 150 that supplies electricity to the heater layer 130. The electric range 100 includes a control part 160 that receives an input signal from each component of the electric range 100 and transmits a control signal. The control part may be implemented as a Micom.

The electric range 100 includes an input part 170 of inputting the on/off and the degree of heating of each heater layers 130*a*, 130*b* and 130*c*. The input unit 170 may include a plurality of buttons or rotating levers. An input signal is transmitted to the control part 160 according to the degree of heating input from the input part 170. The control part 160 may control the power supply part 150 to adjust the both ends voltage applied to the heater layer 130 based on the transmitted signal. The both ends voltage means a voltage applied between the first terminal part 131 and the second terminal part 132.

The electric range 100 may include a temperature detection part 175 for detecting the temperature of the heater layer. The temperature detection part 175 may be composed of a temperature sensor that senses the temperature directly. The temperature detector part 175 may be composed of the device of detecting a voltage and a current applied to the heater layer. The temperature may be sensed by a resistance value calculated from the sensed voltage and current.

The electric range 100 includes a display 180 of outputting a display for confirming information input through the input unit 170. The display 180 may output an indication notifying the current temperature and the on/off state of the heater layers 130*a*, 130*b*, and 130*c*.

A plurality of particular specific resistance values that are generated when the heater layer 130 reaches a plurality of specific heating temperatures are predetermined and stored in the control part 160. The control part 160 receives information about the heating temperature input by the input part 170 and derives the specific resistance value of the heater layer 130 that is generated when the input heating temperature is reached. The control part 160 uses the current I flowing in the heater layer 130 and the voltage V running to the heater layer 13, sensed by the temperature detection part 175 and calculates the resistance value Ω of the heater layer 130. When the calculated resistance value reaches the specific resistance value, the control part 160 turns off the switch of the power supply unit 150 to stop the supply of electricity to the heater layer 130, and after the predetermined time, turns on the switch of the power supply part 150 to supply the electricity to the heater layer 130 again.

Figure 9:
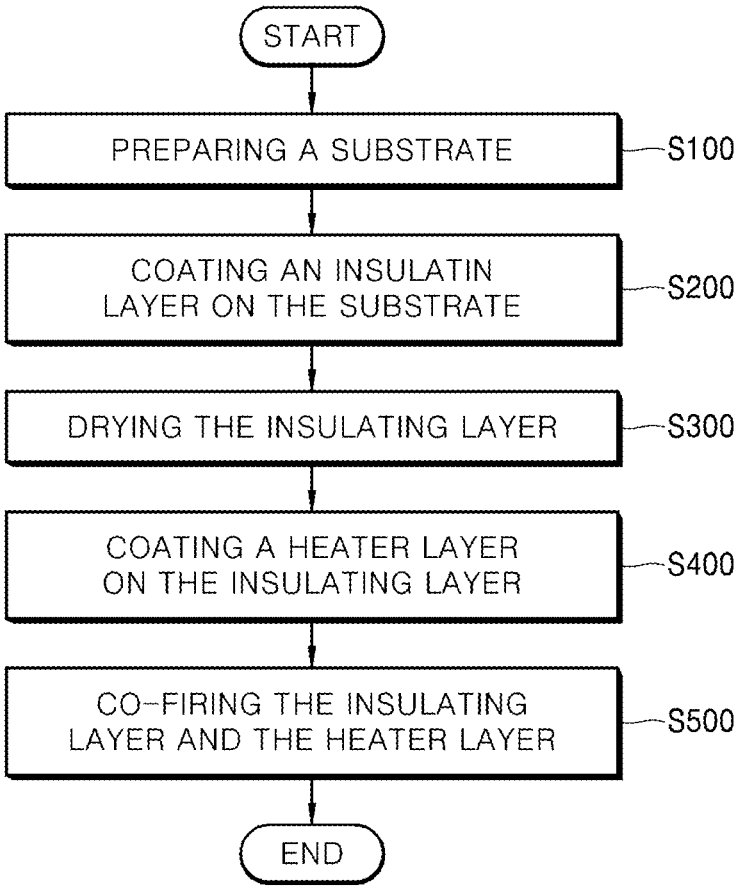
FIG. 9 is a flowchart schematically showing a method of manufacturing the surface heater of the present invention.

Next, a method of manufacturing the surface heater in accordance with an embodiment of the present invention will be described (see FIG. 9).

First, it includes a method of manufacturing the insulating layer on the prepared substrate. The method of manufacturing the insulating layer includes the step of coating the paste on the substrate after preparing the paste of forming the insulting layer.

The paste for forming the insulating layer in the present invention is composed of the powder of boron nitride and Glass frit as the effective inorganic component and the organic Vehicle dispersed with the powder. The vehicle may include a solvent and an organic polymeric binder, and optionally other dissolution materials such as a plasticizer, a release agent, a dispersant, a delaminating agent, a defoaming agent, a stabilizer and a wetting agent, etc.

In order to obtain a better coupling efficiency, it is preferable to use 3% or more by weight of the polymeric binder for 90% by weight of the inorganic powder based on the total composition. Within this range, the use of a possible minimum amount of binder and other low volatile organic additive is preferred to obtain better packing of the powder which reduces the amount of organic material to be removed by pyrolysis and promotes a complete densification during firing.

Various conventional polymeric materials such as poly (vinyl butyral), poly (vinyl acetate), poly (vinyl alcohol), cellulose-based polymer, for example, methylcellulose, ethylcellulose, hydroxyethylcellulose, methylhydroxyehtylcellulose, atctic polyprophylene, polyethylene, silicon polymer, for example, poly (methyl siloxane), poly (methylphenyl siloxane), polystyrene, butadiene/styrene copolymer, polystyrene, poly (vinyl pyrrolidone), polyamide, high molecular weight polyether, compolymer of ethylene oxide and propylene oxide, polyacryliamide, and various acrylic polymers, for example, sodium polyacrylate, poly (lower alkyl acrylate), poly (lower alkyl methacrylate), and various copolymers and polycaprolactones of lower alkyl acrylates and methacrylates as the organic binder.

On the other hand, the polymeric binder also contains a relatively small amount of a plasticizer that functions to reduce the glass transition temperature (Tg) of the binder polymer compared with the binder polymer. The choice of plasticizer is of course determined mainly by the polymer that needs to be modified. Among the plasticizers used in various binder systems, there is diethyl phthalate, dibutyl phthalate, dioctyl phthalate, butyl benzyl phthalate, alkyl phosphates, polyalkylene glycols, glycerol, poly(ethylene oxide), hydroxyethylated alkyl phenols, dialkyl dithiophosphonate and poly(isobutylene). Of these, butyl benzyl phthalate is most commonly used in acrylic polymer systems since it can be effectively used at a relatively low concentration.

It is preferable that the solvent component of the paste secures the complete dissolution of the organic material, in particular, the polymer in the paste, and have a sufficiently high volatile to enable the evaporation even when the heart at a relatively low level is applied under atmospheric pressure. In addition, the solvent must boil well at below the decomposition temperature or the boiling point of any other additives contained in the organic medium. That is, a solvent having an atmospheric pressure boiling point of less than 150° C. is most commonly used. Such solvents include acetone, xylene, methanol, ethanol, isopropanol, methyl ethyl ketone, ethyl acetate, 1,1,1-trichloroethane, tetrachlorethylene, amyl acetate, 2,2,4-triethyl pentane diol-1,3-monoisobutyrate, toluene, methylene chloride and fluorocarbon. The above-mentioned individual solvents may not completely dissolve the binder polymer. However, it works satisfactorily when mixed with other solvent(s).

The paste for forming the insulating layer is coated to the surface of the substrate after the manufacturing. Such coating can be coat the paste using a screen printer as an example. As another example, after casting the paste on the separate flexible substrate, by heating the casted layer to remove the volatile solvent, and forming a green tape, the insulating layer may be formed by laminating the tape by using a roller on the substrate.

It includes the step of drying the coated paste at the predetermined temperature after the coating step. The drying step usually proceeds at a relatively low temperature of 200° C. or lower, and the solvent is mainly evaporated in the drying step.

After drying the insulating layer, a heater layer is coated on the insulating layer. The heater layer may include a step of firstly manufacturing a paste for forming a heating element of the heater layer in the same manner as the insulating layer. The predetermined powder, the organic solvent, and the organic binder are mixed using a mixer and a three roll mill at a temperature of 10 to 30° C. for 2 to 6 hours. After the step of manufacturing the paste, it includes the coating step of coating the paste to the surface of a dielectric layer 20 in a predetermined shape. As an example, the paste can be coated using a screen printer. As another example, the paste can be coated using a vapor deposition method. A coating thickness t of the paste is about 6 to 10 μm.

After the coating of the heater layer, the insulating layer and the heater layer are co-fired. It can further include the step of drying the heater layer prior to the co-firing.

Generally, the firing is a method of high-temperature treatment widely used in mineral processing industry such as ceramics, to put it simply, which means a baking the minerals easily. Here, a mineral is used as a shape in which single mineral, a mixed mineral, or a mineral mixed in a predetermined ratio are molded to the powder shape, a mass shape, and the predetermined shape. The firing may include the chemical reaction such as the pyrolysis, the synthesis, and the substitution, or the sintering depending on the purpose thereof. Therefore, in the ceramic field to which the insulating layer and the heater layer belong in the present invention, sintering for the purpose of densification, etc., is also included in the firing.

The firing in the present invention further includes a Binder Burn-Out (hereinafter referred to as BBO) step of burning out the organic binder, which is an effective component of the vehicle in the paste, in addition to the general firing purpose. It is possible to include the BBO step in the firing step by separately providing a temperature holding period in the firing step for the BBO or through the adjusting method, such as, reducing the heating speed in the temperature period which BBO occurs.

In the method of manufacturing the surface heater 1 in accordance with the present invention, the firing temperature ranges from about 800° C. to 900° C. In the firing step, the heater layer and the insulating layer can be sintered at a firing temperature of 900° C. or less. For this, when the predetermined powder of the heater layer is a mixture of the lanthanide oxide powder and the metal powder, the firing temperature may be lowered to 900° C. or lower. Also, when the insulating layer includes a Glass frit as an inorganic binder, the firing temperature of the insulating layer is also lowered, and co-firing with the heater layer is also possible. Through this, even when the substrate 10 is the glass material, there is an effect of smoothly proceeding the firing step.

When the lanthanide oxide is LC and the metal is Ag in the predetermined powder of the insulating layer, the firing temperature can be further lowered. In this case, in the firing step, the predetermined powder may be sintered at a firing temperature of 850° C. or less. Also, when the Glass frit of the insulating layer includes a borosilicate component, the firing temperature of the insulating layer may be further lowered than 900° C. As such, even when the substrate 10 is a glass material through the relatively low firing temperature, there is an effect of proceeding the firing step more smoothly.

While the present invention has been described with reference to the exemplary drawings thereof as described above, the invention is not limited to the exemplary embodiments and the drawings disclosed in the specification, and it is apparent that many variations can be made by the skilled person in the art within the range of the technical idea of the present invention. In addition, although the working effect in accordance with the configuration of the present invention is not explicitly described while describing the embodiments of the present invention, in the above, it is needless to say that a predictable effect has to be also recognized by the corresponding configuration.

What is claimed is:

1. A surface heater, comprising:
a substrate;
an insulating layer disposed on the substrate; and
a heater layer disposed on the insulating layer,
wherein the insulating layer comprises glass frit as a binder, and
wherein the binder comprises a Borosilicate component and/or a Bentonite component.

2. The surface heater of claim 1, wherein the substrate comprises one of a glass material, a glass-ceramic material, or a ceramic material.

3. The surface heater of claim 1, wherein the insulating layer comprises at least one of Boron nitride, Aluminum nitride, and Silicon nitride.

4. The surface heater of claim 1, wherein the heater layer comprises at least one lanthanide oxide from a group consisting of LSM (Lanthanum Strontium Manganite), LSCF (Lanthanum Strontium Cobalt Ferrite), LNF (Lanthanum Nickel Ferrite), and LC (Lanthanum Cobalt oxide).

5. The surface heater of claim 1, wherein the heater layer comprises a metal powder.

6. The surface heater of claim 5, wherein the metal powder comprises at least one selected from a group consisting of silver (Ag), silver-palladium (Ag—Pd), and copper (Cu).

7. The surface heater of claim 1 wherein the heater layer comprises glass frit having the same composition as the binder of the insulating layer.

8. An electric range, comprising:
a surface heater, comprising:
a substrate,
a co-fired insulating layer disposed on the substrate, and
a co-fired heater layer disposed on the insulating layer,
wherein the insulating layer comprises glass frit as a binder and
wherein the binder comprises a Borosilicate component and/or a Bentonite component.

9. A method of manufacturing a surface heater, comprising:
preparing a substrate;
providing an insulating layer on the substrate;
providing a heater layer on the insulating layer; and
co-firing the insulating layer and the heater layer.

10. The method of claim 9, further comprising: drying the heater layer prior to the co-firing the insulating layer and the heater layer step of the method.

11. The method of claim 9, wherein the substrate comprises one of a glass material, a glass-ceramic material, or a ceramic material.

12. The method of claim 9, wherein the insulating layer comprises at least one of Boron nitride, Aluminum nitride, and Silicon nitride.

13. The method of claim 9, wherein the insulating layer comprises glass frit as a binder.

14. The method of claim 13, wherein the binder comprises a Borosilicate component and/or Bentonite component.

15. The method of claim 9, wherein the heater layer comprises at least one lanthanide oxide from a group consisting of LSM (Lanthanum Strontium Manganite), LSCF (Lanthanum Strontium Cobalt Ferrite), LNF (Lanthanum Nickel Ferrite), and LC (Lanthanum Cobalt oxide).

16. The method of claim 9, wherein the heater layer comprises a metal powder.

17. The method of claim 16, wherein the metal powder comprises at least one selected from a group consisting of silver (Ag), silver-palladium (Ag—Pd), and copper (Cu).

18. The method of claim 13, wherein the heater layer comprises glass frit having the same component as the binder of the insulating layer.

* * * * *